United States Patent [19]

Ryan

[11] 4,381,855

[45] May 3, 1983

[54] TECHNIQUE FOR CONSERVING HOT METAL TEMPERATURE

[75] Inventor: John P. Ryan, Munhall, Pa.

[73] Assignee: Industrial Machine Works, Inc., Murrysville, Pa.

[21] Appl. No.: 261,288

[22] Filed: May 6, 1981

[51] Int. Cl.[3] ..... F27D 3/00

[52] U.S. Cl. ..... 266/248; 266/275; 266/287

[58] Field of Search ..... 414/164, 162; 266/165, 266/248, 240, 275, 287; 220/254, 257, 258, 265

[56] References Cited

U.S. PATENT DOCUMENTS

| | | | |
|---|---|---|---|
| 1,488,026 | 3/1924 | Reilly | 266/275 X |
| 1,969,325 | 8/1934 | Pugh | 266/165 X |
| 4,118,018 | 10/1978 | Gruner et al. | 266/275 |
| 4,260,141 | 4/1981 | Nagati | 266/287 |

*Primary Examiner*—L. Dewayne Rutledge
*Assistant Examiner*—David A. Hey
*Attorney, Agent, or Firm*—Michael P. Lynch

[57] ABSTRACT

A flexible thermal insulating cover member is positioned over the opening of a hot metal containment of a conveying or mixing vessel to reduce the temperature loss from the containment.

10 Claims, 11 Drawing Figures

TECHNIQUE FOR CONSERVING HOT METAL TEMPERATURE

BACKGROUND OF THE INVENTION

In hot metal processes it is important to maintain the hot metal temperature which, in the case of the basic steel making oxygen process, permits the use of a larger percentage of low cost scrap material instead of the high cost hot metal, molten iron.

In a typical steel making process the hot metal is transported between the blast furnace and the melt facility via a hot metal conveying, or mixer, vessel which includes a rotatable submarine type ladle. The rotatable ladle is typically a refractory brick lined metal containment with a ladle mouth opening. In the basic oxygen process, a blast furnace casts the hot metal, i.e., molten iron, through the mouth opening into the ladle of the hot metal conveying vessel. The vessel is subsequently transported to the steel melting facility where the ladle is rotated to empty the hot metal contents of the vessel. The empty hot metal conveying vessel is then returned to the blast furnace and the cycle is repeated. A convention hot metal conveying vessel is described in U.S. Pat. No. 4,260,141 entitled "Centerplate Wear Liners" which is incorporated herein by reference.

It has been determined, experimentally, that the ladle refractory temperature has a significant effect on the hot metal temperature as delivered to the steel melting facility. Significant refractory temperature losses occur during the period beginning when the time the ladle is emptied at the melting facility and subsequently reused at the blast furnace. The magnitude of this loss is a function of the above time frame, the hot metal temperature prior to emptying, ambient temperature conditions, and the size of the ladle mouth opening. The refractory temperature loss is accelerated by the natural stack effect of the ladle mouth opening. It has been further noted that the rate of refractory temperature loss is greatest immediately following the emptying of the ladle at the steel melting facility.

SUMMARY OF THE INVENTION

There is disclosed herein with reference to the accompanying drawings a novel technique for reducing the loss in hot metal temperature in hot metal processes thereby resulting in significant energy savings through hot metal temperature conservation. The technique includes the positioning of a thermal insulating cover over the mouth opening of the conveying vessel.

In the steel making process several significant benefits are realized when the temperature loss of the ladle refractory material is reduced through the use of the ladle mouth cover, these benefits include:

(a) the amount of expensive hot metal (molten iron) required to maintain the hot metal temperature is less, thus permitting an increased use of low cost scrap in the steel making process;

(b) the build up of residue resulting from the slag and kish remaining within the ladle and the ladle mouth opening is minimized by the higher refractory temperature realized through the use of the mouth cover. The higher refractory temperature reduces the tendency for the slag and kish to accumulate and solidify. This reduction of build up or solidified residue reduces the requirements for vessel cleaning and minimizes the reduction in the carrying capacity of the vessel which would occur in the event of significant residue build up.

DESCRIPTION OF THE DRAWINGS

The invention will become more readily apparent from the following exemplary description in connection with the accompanying drawings.

DESCRIPTION OF THE PREFERRED EMBODIMENT

Figure 1A:
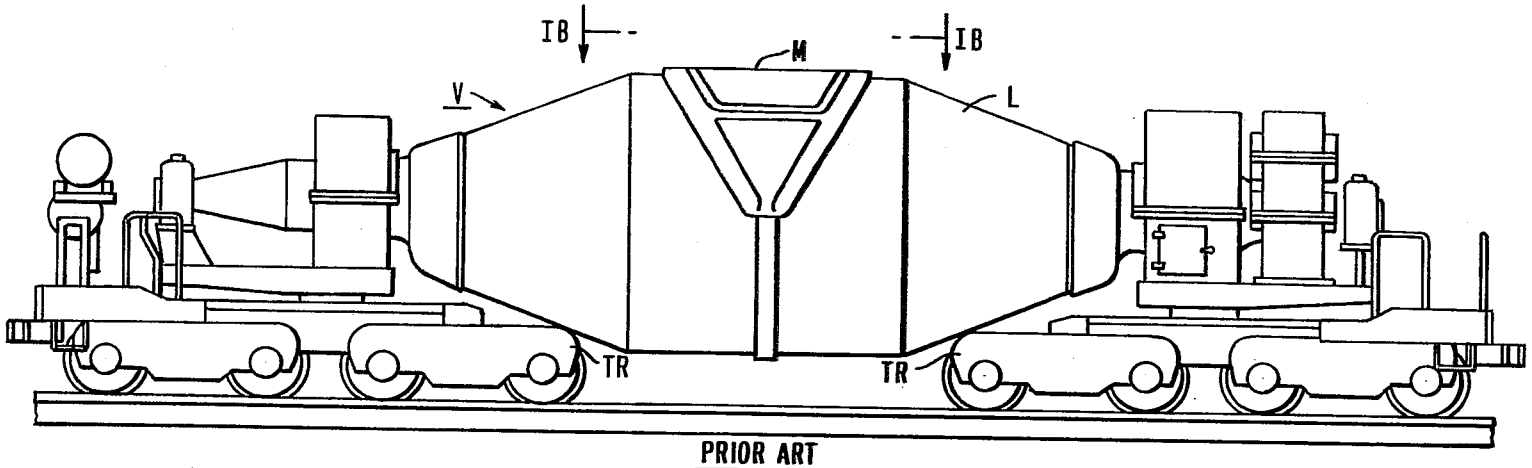
PRIOR ART FIG. 1A
FIG. 1A is a Prior Art schematic illustration of a hot metal conveying vessel and FIG. 1B is a section view of the illustration of FIG. 1A.
Figure 1B:
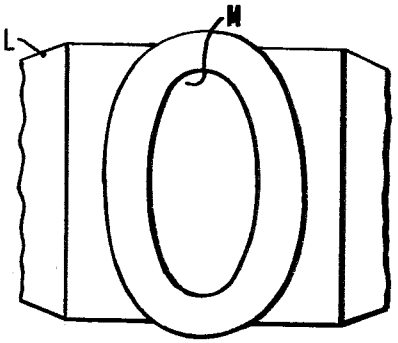
PRIOR ART FIG. 1B

Referring to FIGS. 1A and 1B there is illustrated a Prior Art embodiment of a hot metal conveying vessel V consisting of a rotatable ladle L having a mouth opening M and secured to a transport device TR.

At the blast furnace of a typical steel making process the hot metal (molten iron) is cast through a tapping hole, or holes, located in the furnace hearth. The hot metal is supplied to the vessel V by refractory lined iron runners, or troughs. The hot metal is cast, or charged, into the ladle L through the mouth opening M. The temperature of the hot metal at the blast furnace is typically about 2700° F. while the corresponding hot metal temperature when the vessel V arrives as the melting facility is about 2420° F. When the emptied vessel V is returned to the blast furnace the corresponding refractory temperature of the ladle L is about 1650° F. Thus a temperature drop of about 280° F. is experienced between the blast furnace and the melting facility and a further refractory temperature drop of about 770° F. occurs between the melting facility and the blast furnace. A major factor in the drop in refractory temperature is the natural stack effect of the ladle mouth opening M.

Figure 2A:
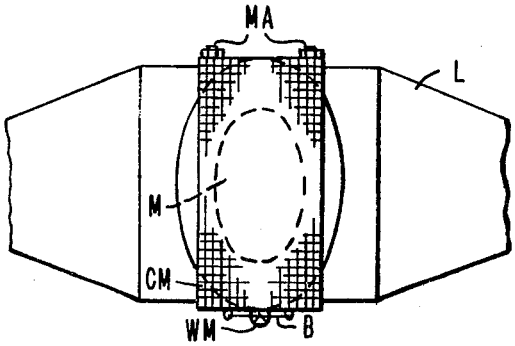
FIGS. 2A and 2B illustrate the application a novel thermal insulating cover member in combination with the ladle of the hot metal conveying vessel of FIG. 1.
Figure 2B:
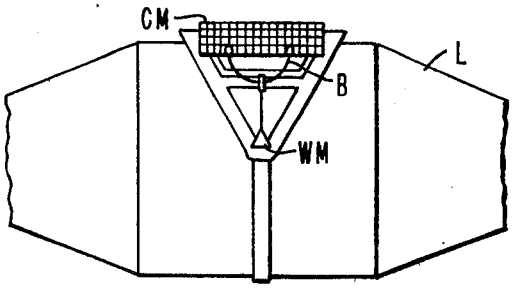

Referring to FIGS. 2A and 2B an insulating cover member CM is positioned over the ladle mouth opening M of the vessel V. It has been verified experimentally that the use of the insulating cover member CM reduces significantly both the loss in hot metal temperature during the transport of the vessel V between the blast furnace and the melting facility and the loss in refractory material temperature of the ladle L between the melting facility and the blast furnace. The cover member CM is mechanically secured to the vessel V through the use of suitable mechanical attachments MA, such as bolts or slide pins. The cover member CM is maintained in position across the ladle mouth opening M by a weight member WM extending from banding material B which is attached to the opposite end of the cover member CM.

While the use of the cover member CM is described herein with reference to a steel making process the benefits derived from the cover member CM are applicable in numerous hot metal handling operations including foundry operations and aluminum metal processing.

The construction of the cover member CM can vary depending on the application. It may be a rigid, impervious cover which is positioned over the mouth opening M after the hot metal is cast, or charged, into the ladle L, removed while the hot metal is emptied, or discharged, from the ladle L, and repositioned over the opening M while the emptied vessel V is returned to the blast furnace. Inasmuch as the most significant heat loss experienced in the steel making process occurs after the ladle L is emptied at the melting facility, the use of the cover member CM could be limited to the time the vessel V is returned to the blast furnace from the melting facility.

Figure 3A:
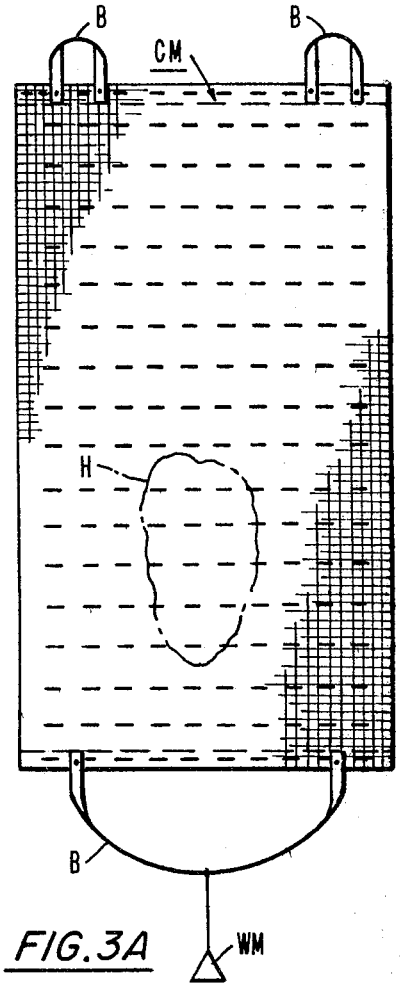
FIGS. 3A and 3B are detail illustrations of an embodiment of the cover member of FIGS. 2A and 2B.
Figure 3B:
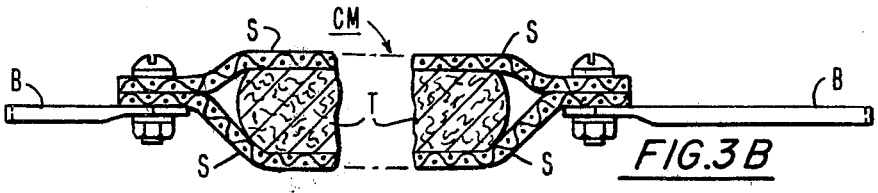

A requirement to remove a cover member CM at the blast furnace in a steel making process can present problems due to the limited space and the environment. Thus a preferred cover member construction is one which permits the cover member CM to remain in place over the opening M during the casting of the hot metal into the ladle L. This implementation of the thermal insulator cover member CM is illustrated in FIGS. 3A and 3B as a flexible cover member CM. Banding material B is used to secure the cover member CM to the mechanical attachments MA of FIG. 2A and to support the weight member WM.

A thermal insulating material T, such as commercially available Kaowool, is mechanically supported by flexible metallic or non-metallic screen elements S to form a flexible multilayer blanket S-T-S. The screen elements S not only provide the desired mechanical support and a means for securing the cover member CM to the ladle L but they also provide the desired cover flexibility which will enable the cover member CM to conform to the contour of the mouth opening M to minimize temperature loss from the ladle L. The screen and thermal insulating material, and gage of material is determined by the application. Suitable metallic material for the screen elements include steel, stainless steel, monel, etc. of a desired gage.

Figure 4A:
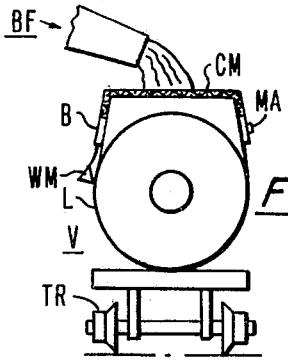
FIGS. 4A, 4B, 4C and 4D illustrate the use of the cover member in a steel making process.
Figure 4B:
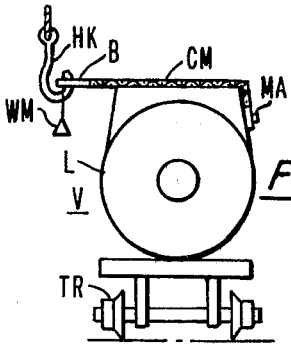
Figure 4C:
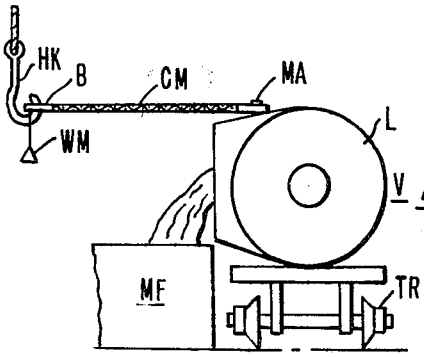
Figure 4D:
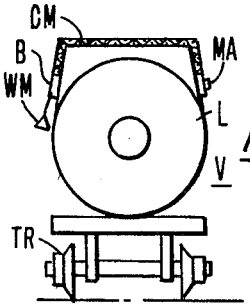
Figure 5:
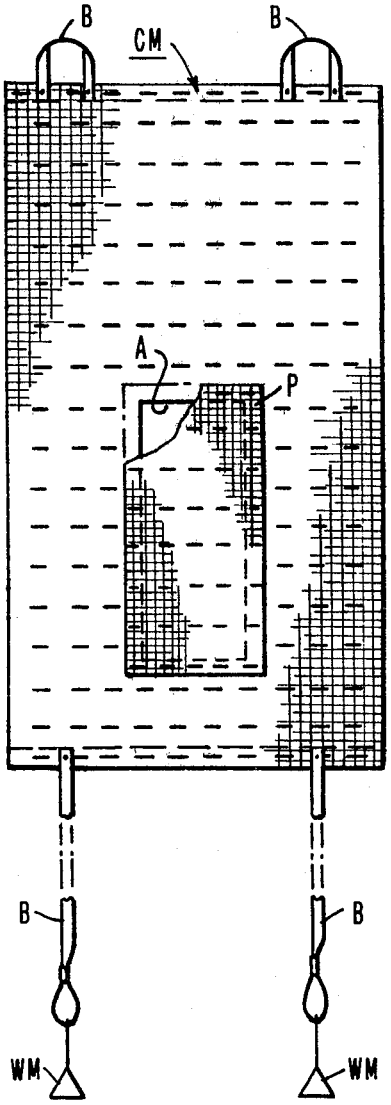
FIG. 5 is an alternate embodiment of the cover member.

A disposable, or repairable, cover member construction which permits the casting of the hot metal through the flexible cover member CM of FIGS. 3A and 3B has proven to be both effective and economical. A light weight screen material, such as conventional storm window screening, serves as the screen elements S. The contact of the hot metal with this construction of the flexible cover member CM creates a hole H in the cover member and the hot metal passes through the hole H into the ladle L. After several uses the cover member CM is discarded or a thermal insulating patch member, such as that illustrated as patch P of FIG. 5, is placed over the hole H during the time the vessel V is being transported between the hot metal handling stations of the metal process. posable flexible cover member CM of FIGS. 3A and 3B for the retention of ladle refractory temperature during the transmit of the vessel V between the blast furnace BF and the melting facility MF. The cover member CW of FIG. 4A is maintained in position over the mouth opening M and the hot metal is cast from the blast furnace BF through the cover member CM and into the ladle L. When the vessel V is transported to the melting facility MF, as illustrated in FIG. 4B, a hook H of a lifting apparatus (not shown) is attached to the banding element B. The raising of the cover member CM by the hook H in combination with the rotation of the ladle L as shown in FIG. 4C removes the cover member CM from the mouth opening M and the hot metal is poured from the ladle L into the melting facility MF. The ladle L is then returned to its upright position and the hook H lowers the cover member CM over the mouth opening M, as shown in FIG. 4D. The vessel V is then returned to the blast furnace BF and the cycle is repeated.

As an alternative the thermal insulating cover member CM can be designed with an aperture, or opening, A as illustrated in FIG. 5. This cover design permits the casting of the hot metal through the aperture A without damaging contact with the cover member CM. A patch P of the cover member composition is positioned over the aperture A to reduce temperature loss during the transmit time of the vessel V.

The effectiveness of the thermal insulating cover member CM in conserving refractory temperature has been determined experimentally. A temperature loss from about 2700° F. to about 1650° F. is experienced between the time the vessel V leaves the blast furnace and the time it returns to the blast furnace when a cover member is not used. A similar cycle of the vessel V with the cover member CM in place has resulted in a significant conservation in temperature with the corresponding temperatures being 2700° F. and 1950° F., respectively.

Inasmuch as the most significant temperature loss occurs between the time the vessel V leaves the melt facility and returns to the blast furnace, the use of the cover member CM could be limited to this portion of the cycle illustrated in FIGS. 4A–4D. This would eliminate the damage to the cover member CM during the hot metal casting at the blast furnace.

The conservation of refractory temperature realized through the use of the cover member CM improves the ratio of hot metal to scrap in the batch steel making process. This means that more low cost scrap can be used thereby reducing the cost of producing a ton of steel.

I claim:

1. In a hot metal processing system including a containment for transporting hot metal, said containment having an opening to permit the pouring of the hot metal into said containment at a first process station and the subsequent removal of said hot metal from said containment at a second process station, the improvement for reducing the temperature loss from said containment, said improvement comprising, a multi-layer, flexible thermal insulating cover means for positioning over said opening, said multi-layer flexible thermal insulating cover means comprised of at least one flexible thermal insulating element and at least one flexible screen element.

2. In the improvement of claim 1 wherein the material composition of said multi-layer, flexible thermal insulating cover means is such that permits hot metal to be poured through said cover means to form a hole therein for the passage of said hot metal into said containment.

3. In the improvement of claim 1 further including mechanical means for maintaining said multi-layer, flexible thermal insulating cover means in position over the opening of said containment, said cover means conforming to the contour of said containment opening.

4. In the improvement of claim 1 wherein said multi-layer, flexible thermal insulating cover means includes an aperture therein to permit the pouring of hot metal through the multi-layer, flexible thermal insulating cover means into said containment and a thermal insulating patch element for positioning over the aperture.

5. In the improvement of claim 2 further including a multi-layer, flexible thermal insulating patch element for covering the hole produced in said cover by the pouring of hot metal therethrough.

6. A cover apparatus for positioning over the opening of a rotatable submarine type ladle for transporting hot metal, comprising, a multi-layer, flexible thermal insulating cover means.

7. A cover apparatus as claimed in claim 6 wherein said cover means includes at least one flexible thermal insulating element and at least one flexible metal screen element, said cover means conforming to the contour of the opening of said rotatable submarine type ladle.

8. A cover apparatus as claimed in claim 6 further including mechanical means for maintaining said multi-layer, flexible thermal insulating cover means in position over the opening of said rotatable submarine type ladle.

9. A cover apparatus as claimed in claim 6 wherein the material composition of said cover is such that permits hot metal to be poured through said cover means to form a hole therein for the passage of said hot metal into said ladle.

10. A method for minimizing the refractory heat loss of a submarine type hot metal ladle after the emptying of the hot metal from the ladle, comprising the step of, covering the opening of the submarine type ladle after emptying the hot metal with a flexible thermal insulating cover means which conforms to the contour of said opening.

* * * * *

UNITED STATES PATENT AND TRADEMARK OFFICE

CERTIFICATE OF CORRECTION

PATENT NO. : 4,381,855

DATED : May 3, 1983

INVENTOR(S) : John P. Ryan

It is certified that error appears in the above—identified patent and that said Letters Patent is hereby corrected as shown below:

Column 3, line 54:

After "the metal process." begin a new paragraph with the new words:

"Referring to the sequence of Figures 4A, 4B, 4C and 4D, there is illustrated the application of the dis-" and continue with the wording on line 54, "posable flexible..."

Signed and Sealed this

*Fourth* Day of *February 1986*

[SEAL]

*Attest:*

DONALD J. QUIGG

*Attesting Officer*

*Commissioner of Patents and Trademarks*

REEXAMINATION CERTIFICATE (477th)

United States Patent [19] [11] B1 4,381,855

Ryan [45] Certificate Issued Apr. 1, 1986

[54] TECHNIQUE FOR CONSERVING HOT METAL TEMPERATURE

[75] Inventor: John P. Ryan, Munhall, Pa.

[73] Assignee: Industrial Machine Works, Inc., Murrysville, Pa.

Reexamination Request:
No. 90/000,735, Mar. 11, 1985

Reexamination Certificate for:

| | |
|---|---|
| Patent No.: | **4,381,855** |
| Issued: | **May 3, 1983** |
| Appl. No.: | **261,288** |
| Filed: | **May 6, 1981** |

Certificate of Correction issued Feb. 4, 1986.

[51] Int. Cl.[4] ..... F27D 3/14
[52] U.S. Cl. ..... 266/248; 266/275; 266/287

[58] Field of Search ..... 266/165, 248, 240, 275, 266/280, 287; 414/164, 162; 220/254, 257, 258, 265; 428/605, 608; 501/95, 36

[56] References Cited

PUBLICATIONS

Pocius, August & E. J. Bland, "Johns-Manville Refractory-Fiber Facts", Oct. 25, 1967, pp. 1-4.
"Refractory Fibers", vol. 17, p. 293.
Johns-Manville Company, "J-M Materials for Turbine Blankets-Enclosed Mineral Fiber Insulation", pp. 1-3.
"Hot Metal and Refractory Temperature Study of Torpedo Cars at Interlake, Inc." by Steven G. Jansto; Proceedings of the 39th Ironmaking Conference, vol. 39, pp. 43-48, Mar. 23-26, 1980.

*Primary Examiner*—L. Dewayne Rutledge

[57] ABSTRACT

A flexible thermal insulating cover member is positioned over the opening of a hot metal containment of a conveying or mixing vessel to reduce the temperature loss from the containment.

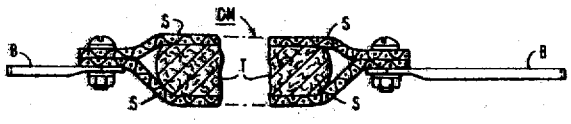

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–5 is confirmed.

Claims 7, 8 and 10 are cancelled.

Claims 6 and 9 are determined to be patentable as amended.

6. A cover apparatus for positioning over the opening of a rotatable submarine type ladle for transporting hot metal, comprising:

a multi-layer, flexible thermal insulating cover means, *said cover means including at least one flexible thermal insulating element and at least one flexible screen element, and said cover means being conformable to the contour of the opening of said rotatable submarine type ladle; and*

*mechanical means for maintaining said multi-layer, flexible thermal insulating cover means in position over the opening of said rotatable submarine type ladle.*

9. A cover apparatus [as claimed in claim 6] *for positioning over the opening of a rotatable submarine type ladle for transporting hot metal, comprising:*

*a multi-layer, flexible thermal insulating cover means, said cover means including at least one flexible thermal insulating element and at least one flexible screen element, and said cover means being conformable to the contour of the opening of said rotatable submarine type ladle;* wherein the material composition of said cover *means* is such that permits hot metal to be poured through said cover means to form a hole therein for the passage of said hot metal into said ladle.

* * * * *